United States Patent [19]

Novy Velinger

[11] 4,134,946

[45] Jan. 16, 1979

[54] PROCESS FOR BRIQUETING FLUORSPAR WITH SODIUM CARBONATE

[76] Inventor: Antonio Novy Velinger, Concha Espina, 41-2°, Madrid, Spain

[21] Appl. No.: 703,298

[22] Filed: Jul. 7, 1976

[30] Foreign Application Priority Data

Jul. 15, 1975 [ES] Spain ..... 439.453

[51] Int. Cl.$^2$ ..... C04B 35/66

[52] U.S. Cl. ..... 264/63; 75/55; 106/73.1

[58] Field of Search ..... 264/63, 125; 106/73.4, 106/73.1, 63; 75/55

[56] References Cited

U.S. PATENT DOCUMENTS

| | | | |
|---|---|---|---|
| 2,184,078 | 12/1939 | Hyde | 75/55 |
| 2,465,955 | 3/1949 | Wynne et al. | 75/55 |
| 2,506,244 | 5/1950 | Stopka | 264/63 |
| 3,276,860 | 10/1966 | Lintz | 75/55 |

*Primary Examiner*—Robert F. White
*Assistant Examiner*—John A. Parrish
*Attorney, Agent, or Firm*—Wenderoth, Lind & Ponack

[57] ABSTRACT

Fluorspar is formed into briquettes by thoroughly mixing fluorspar ore with water and an agglomerating agent, for example sodium carbonate, pressing the mixture and calcining the pressed product.

4 Claims, No Drawings

PROCESS FOR BRIQUETING FLUORSPAR WITH SODIUM CARBONATE

Fluorspar ($CaF_2$) is an essential ingredient in the modern manufacture of steels, for which no substitute, which is equivalent thereto, has heretofore been found. It is likewise employed in the metallurgy of other metals as a fluxing agent or as a component which reduces the viscosity of the slags, besides having a desulphurizing action.

However, the rate of high flow of gases which predominates in the metallurgical furnaces imposes the condition that the size of the grain of the fluorspar used in metallurgy should be suitably thick to avoid losses due to hauling with the gases. It was heretofore possible to encounter fluorspar, sufficiently rich in $CaF_2$, which, at the same time, had a thick granulometry, suitable for its use in siderurgy or metallurgy. However, of late, the exhaustion of ores having adequate characteristics as well as the increasing demand for fluorspar, have promoted the exploitation of deposits wherein fluorspar is intimately mixed with other components, mainly silica. A greater grinding is, evidently, necessary for these ores, so that they can reach a grain size which is sufficiently fine in order that a complete liberation of the components of the ore exists and so that the mixed grains disappear, wherein the fluorspar is joined to an impurity which is usually precisely silica which constitutes a component especially resistant to the beneficial action of the fluorspar in siderurgy. With a fine granulometry, flotation is the only process of separation between the fluorspar and the ore, and it is known that this process requires granulometries of decimals of a millimeter or lower.

Under these conditions there is no other solution to satisfy the demand for fluorspar having a sufficiently high grade and, at the same time, a thick granulometry which agglomerates the concentrates obtained by flotation to attain suitably sized briquettes. These briquettes should, naturally, have a sufficient mechanical resistance, but they should furthermore be reasonably free of harmful impurities which could be contributed by the agglomerating agent used, as can take place with cement (silica) and with a sulphur-containing agglomerating agent (bisulphite pitch).

The beneficial action which the sodium carbonate, also known as Solvay soda, exercises in siderurgy as a desulphurizing agent, is also known. However, there is no reason to believe that the anhydrous sodium carbonate can exercise an agglomerating action of the fluorspar.

The object of the present invention is precisely to propose the use of sodium carbonate for this purpose, since the sodium carbonate, under the conditions herebelow specified, acts as an agglomerating agent of the fluorspar, proportioning to the briquettes obtained a special solidity, besides communicating thereto its beneficial action as a useful ingredient in siderurgy and in the metallurgy of various metals.

The process of briqueting with sodium carbonate as the agglomerating agent comprises the following steps:

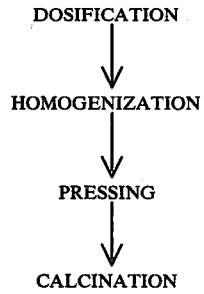

Dosification — Consists in the addition to the fluorspar ore of an adequate amount of agglomerating agent, whose optimum is between 2.5 and 3 % of $Na_2CO_3$, and of an amount of water suitable for pressing, whose optimum is about 5%, based on the weight of the ore, although higher or somewhat lower amounts of sodium carbonate as well as water do not impede agglomeration. The properties of the crude briquettes can be improved, that is to say before calcinaton, by means of the addition of substances which contribute in giving a higher stability to the briquettes in their handling before calcination, such as for example, polyglycols, waxes, bitumen, etc.

Homogenization — Consists in an intimate mixing of the ingredients, especially of the ingredients essential for the process: sodium carbonate and water, in the suitable proportions.

Pressing — This can be conducted at different pressures, but an excellent mechanical resistance is obtained with pressures of 300 to 600 $Kg/cm^2$, the optimum pressure being 400 $Kg/cm^2$.

Calcination — Drying and calcination takes place in the same furnace at temperatures which vary according to the desired characteristics of the briquette, between 700° C. and 880° C., but the optimum is found between 850° and 860° C., for 5 minutes. Under these conditions and with 3% $Na_2CO_3$ and 5% water, briquettes having a 250 $Kg/cm^2$ resistance to compression were obtained.

Instead of sodium carbonate, other alkali or alkali earth components, such as potassium carbonate, sodium hydroxide, calcium hydroxide, and others, can be used.

I claim:

1. A process for briqueting fluorspar which comprises
   - thoroughly mixing fluorspar ore with about 5% of water and 2.5 to 3% of an agglomerating agent selected from the group consisting of sodium carbonate, potassium carbonate, sodium hydroxide and calcium hydroxide, based on the weight of the ore,
   - pressing the resultant mixture at a pressure of 300 to 600 $Kg/cm^2$, and
   - calcining the pressed product at a temperature of 700° to 880° C. for 5 minutes.

2. A process according to claim 1, wherein the agglomerating agent is sodium carbonate.

3. A process according to claim 1, wherein the pressing is carried out at a pressure of 400 $Kg/cm^2$.

4. A process according to claim 1, wherein calcining is carried out at a temperature of 850° to 860° C.

* * * * *